US009628929B2

(12) United States Patent
Salvia et al.

(10) Patent No.: US 9,628,929 B2
(45) Date of Patent: Apr. 18, 2017

(54) BACK CAVITY LEAKAGE TEST FOR ACOUSTIC SENSOR

(71) Applicant: Invensense, Inc., San Jose, CA (US)

(72) Inventors: James Christian Salvia, Redwood City, CA (US); Baris Cagdaser, Sunnyvale, CA (US); Aleksey S. Khenkin, Nashua, NH (US)

(73) Assignee: INVENSENSE, INC., San Jose, CA (US)

( * ) Notice: Subject to any disclaimer, the term of this patent is extended or adjusted under 35 U.S.C. 154(b) by 518 days.

(21) Appl. No.: 14/149,708

(22) Filed: Jan. 7, 2014

(65) Prior Publication Data

US 2015/0195665 A1 Jul. 9, 2015

(51) Int. Cl.
*H04R 29/00* (2006.01)
*H04R 19/00* (2006.01)

(52) U.S. Cl.
CPC ..... *H04R 29/004* (2013.01); *H04R 19/005* (2013.01); *H04R 2201/003* (2013.01)

(58) Field of Classification Search
USPC ..... 381/56, 58, 60, 113, 191; 73/753, 700, 73/777; 257/415–420; 361/290; 324/353, 600, 686
See application file for complete search history.

(56) References Cited

U.S. PATENT DOCUMENTS 8,692,340 B1 * 4/2014 Ata ..... B81B 3/001 257/415
8,783,113 B2 * 7/2014 Robert ..... B81B 3/0021 73/700
2014/0266263 A1 * 9/2014 Wurzinger ..... G01R 27/2605 324/686
2014/0363004 A1 * 12/2014 Porjo ..... H04R 1/28 381/58

* cited by examiner

*Primary Examiner* — Vivian Chin
*Assistant Examiner* — Friedrich W Fahnert
(74) *Attorney, Agent, or Firm* — Maryam Imam; Klintworth & Rozenblat IP LLC

(57) ABSTRACT

An acoustic sensor system has an acoustic sensor with a cavity, a cavity leakage, and a cavity pressure. The acoustic sensor system further has a test controller coupled to the acoustic sensor that causes a change in the cavity pressure. A response of the acoustic sensor to the change in the cavity pressure is used to measure the cavity leakage.

26 Claims, 4 Drawing Sheets

BACK CAVITY LEAKAGE TEST FOR ACOUSTIC SENSOR

FIELD OF TECHNOLOGY

Various embodiments of the invention relate generally to an acoustic sensor and particularly to testing of the acoustic sensor.

BACKGROUND

Leakage in the cavity of an acoustic sensor is traditionally detected by measuring the sensor's response to acoustic signals at very low frequencies (for example, frequencies below 100 Hz). This can be a challenging and costly measurement step oftentimes entailing limitations related to the types of leaks that can be detected. Clearly, such cavity leaks are undesirable and need be detected if for no other reason than for quality control purposes.

An acoustic sensor is currently tested for cavity leakage during manufacturing through application of an external acoustic stimulus, as is well-known to those skilled in the art. It is also known to those skilled in the art that this testing method may have limitations in detecting certain undesirable leakage paths, therefore creating a risk in manufacturing defective acoustic sensors.

By way of example, traditional acoustic leakage tests involve applying an acoustic signal to the sensor element using a test speaker that is connected to the sensor input through an acoustic channel. A tight seal is formed between the acoustic sensor input and the acoustic channel typically using a gasket. These traditional acoustic leakage tests can reliably quantify the leakage path between the cavity and the acoustic sensor input by measuring the acoustic sensor's response to low frequency acoustic inputs as described earlier.

However, traditional tests have difficulty measuring the leakage path from the cavity to the outside world. Accordingly, both leaks cannot be measured using conventional testing methods. Furthermore, the capability of testing the acoustic sensor in the field, requiring a test speaker, can be costly.

Therefore, the need arises for an acoustic sensor system that allows testing of its acoustic sensor in the field, with reduced costs, and measurement of multiple cavity leaks.

SUMMARY

Briefly, an embodiment of the invention includes an acoustic sensor system having an acoustic sensor with a cavity, a cavity leakage, and a cavity pressure. The acoustic sensor system further has a test controller coupled to the acoustic sensor that causes a change in the cavity pressure. A response of the acoustic sensor to the change in the cavity pressure is used to measure the cavity leakage.

A further understanding of the nature and the advantages of particular embodiments disclosed herein may be realized by reference of the remaining portions of the specification and the attached drawings.

DETAILED DESCRIPTION OF EMBODIMENTS

In the described embodiments, integrated Circuit (IC) substrate may refer to a silicon substrate with electrical circuits, typically CMOS circuits. A cavity may refer to a recess in a substrate. An enclosure may refer to a fully enclosed volume typically surrounding the MEMS structure and typically formed by the IC substrate, structural layer, MEMS substrate, and the standoff seal ring. A port may be an opening through a substrate to expose the MEMS structure to the surrounding environment.

In the described embodiments, an engineered silicon-on-insulator (ESOI) wafer may refer to a SOI wafer with cavities beneath the silicon device layer or substrate. Chip includes at least one substrate typically formed from a semiconductor material. A single chip may be formed from multiple substrates, where the substrates are mechanically bonded to preserve the functionality. Multiple chip includes at least 2 substrates, wherein the 2 substrates are electrically connected, but do not require mechanical bonding. Typically, multiple chips are formed by dicing wafers. A package provides electrical connection between the bond pads on the chip to a metal lead that can be soldered to a PCB. A package typically comprises a package substrate and a cover.

In the described embodiments, a cavity may refer to an opening or recession in a substrate wafer, and enclosure may refer to a fully enclosed space. In the described embodiments, cavity may refer to a partial enclosed cavity equalized to ambient pressure via Pressure Equalization Channels (PEC). In some embodiments, cavity is also referred to as back chamber. A cavity formed with in the CMOS-MEMS device can be referred to as integrated cavity. Pressure equalization channel, also referred to as leakage channels/paths, is an acoustic channel for low frequency or static pressure equalization of cavity to ambient pressure.

In the described embodiments, a rigid structure within an acoustic system may be referred to as a plate. A back plate may be a perforated plate used as an electrode. A plate that moves when subjected to force may be referred to as a moveable sensor element.

In the described embodiments, perforations refer to acoustic openings for reducing air damping. Acoustic port may be an opening for sensing the acoustic pressure. Acoustic barrier may be a structure that prevents acoustic pressure from reaching certain portions of the device. Linkage is a structure that provides compliant attachment to substrate through anchor. Extended acoustic gap can be created by step-etching of a post and creating a partial post overlap over the PEC. In-plane bump stops are extensions of the plate that limit range of movement of the moveable sensor element in the plane of the plate. Rotational bump stop are extensions of the plate or the moveable sensor element to limit range of rotations of the moveable sensor element.

Figure 1:
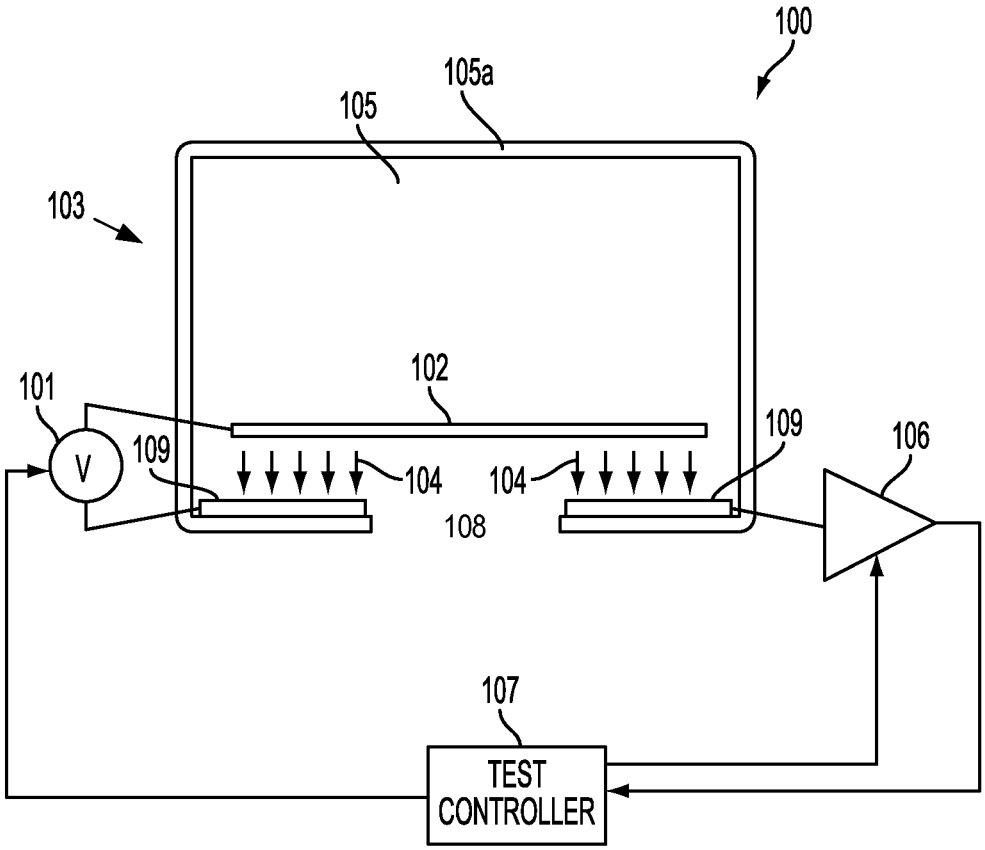
FIG. 1 shows an acoustic sensor system for testing cavity leakage of an acoustic sensor, in accordance with an embodiment of the invention.

Referring now to FIG. 1, an acoustic sensor system 100 is shown for testing cavity leakage of an acoustic sensor, in accordance with an embodiment of the invention. The system 100 is shown to include an acoustic sensor 103, a voltage source 101, a test controller 107, and a sense amplifier 106. It is understood that the system 100 is merely one of many contemplated implementations of an acoustic sensor system that fall within the scope and spirit of the invention.

The acoustic sensor 103 is shown to include a moveable sensor element 102, a cavity 105, electrodes 109, and an acoustic port 108. Further shown in the acoustic sensor 103, by use of arrows, is force 104.

In some embodiments, the acoustic sensor 103 is a microphone, such as but not limited to a MEMS microphone. In some embodiments, the cavity 105 is a back cavity. In some embodiments, the force 104 is an electrostatic force. In some embodiments, the force 104 is a magnetic, thermal, or piezoelectric force. With respect to the various embodiments and methods discussed and shown herein, the force 104 is presumed to be an electrostatic force.

In still other embodiments, the moveable sense element 102 is split into two members (or "sense elements"), with one member being at the illustrated location of the sense element 102 in, FIG. 1, and the other member being between the lid 105*a* and a location between the illustrated moveable sensing element 102 in FIG. 1. In the embodiment where two membranes make up the moveable sense element, one membrane of the moveable sense element is used for testing and the other is used for sensing.

The voltage source 101 is shown connected to one of the electrodes 109 and the moveable sensing element 102. The test controller 107 is shown coupled to the sense amplifier 106 and the voltage source 101. The voltage source 101, test controller 107, and sense amplifier 106 are shown located externally to the acoustic sensor 103, in the embodiment of FIG. 1.

The test controller 107 enables the voltage source 101 to apply a voltage between the moveable sensing element 102 and electrodes 109. This applied voltage creates an electrostatic force, i.e. the force 104, which moves the moveable sensing element 102 downwardly away from the lid 105*a* thereby increasing the volume of the cavity 105, and therefore decreasing the pressure inside the cavity 105. The port 108 is positioned under the sense element 102 and between the electrodes 109.

In accordance with an embodiment and method of the invention, the voltage source 101 is enabled by the test controller 107 sending a command to the acoustic sensor 103.

In some embodiments of the invention, the test controller 107 and the acoustic sensor 103 are in the same package. In some embodiments of the invention, the acoustic sensor 103 and the test controller 107 are disposed on the same integrated circuit.

During operation of the acoustic sensor 103, through the port 104, the acoustic sensor 103 receives sound waves that affect the movement of the moveable sense element 102, which is also referred to as a diaphragm. The movement of the moveable sense element 102 changes the capacitance formed between the electrodes 109 and the moveable sense element 102. This change in capacitance ultimately translates to acoustic sensing as readily known to those skilled in the art.

In some embodiments of the invention, the response of the acoustic sensor 103 has an exponential decay, which is further described below. The test controller 107 determines the cavity leakage by measuring the rate of the exponential decay of the cavity leakage.

In FIG. 1, after an initial fast response to the electrostatic force 104, the moveable sensing element 102 will continue to move slowly in response to the slow pressure equalization between the cavity 105 and the environment, i.e. the outside world. The output of the sense amplifier 106 tracks the motion of the moveable sensing element 102. In many cases, the motion of the moveable sensing element 102, in response to the electrostatic force 104, is large enough to saturate or otherwise temporarily degrade the performance of the sense amplifier 106. In some embodiments of the invention, to avoid this problem, the test controller 107 holds the sense amplifier 106 in a reset mode for an amount of time that is sufficient for the moveable sensing element 102 to complete its motion in response to the electrostatic force 104. At an appropriate time, the test controller 107 releases the sense amplifier 106 from reset mode thereby causing the output of the sense amplifier 106 to track the motion of the moveable sensing element 102 in response to the change in the pressure of the cavity 105.

The test controller 107 analyzes the output of the sense amplifier 106. From this analysis, the test controller 107 extracts information about leakage from the cavity 105.

Figure 2A:
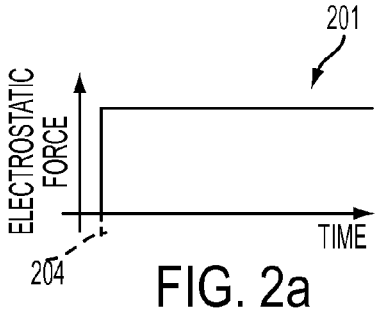
FIGS. 2*a*-2*e* show various responses to the application of an electrostatic force, in the form of graphs.

FIGS. 2*a*-2*e* show various responses to the application of the electrostatic force 104 of FIG. 1, in the form of graphs. In FIG. 2*a*, the graph 201 shows electrostatic force, in the y-axis, versus time, in the x-axis. The graph 201 shows the electrostatic force to be in the form of a step function applied to the moveable sense element 102 and causing the cavity pressure of the cavity 105 to have a response such as shown by graph 202, in FIG. 2*b*. Rather than a step function, the electrostatic force may be in the form of an impulse, sinusoidal or any other type of form that allows extraction of the cavity leakage from time constant information that is contained in the measured motion of the moveable sensor element.

Figure 2B:
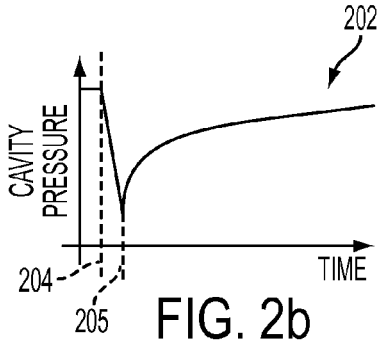
Figure 2C:
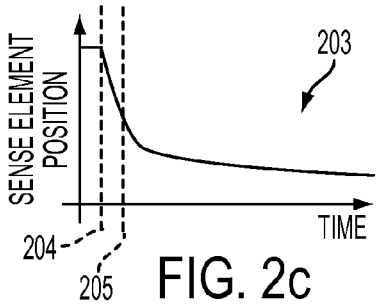
Figure 2D:
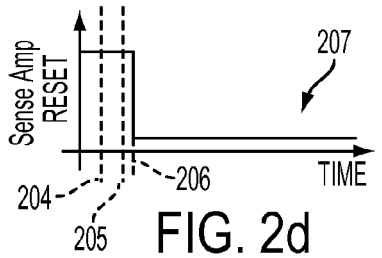
Figure 2E:
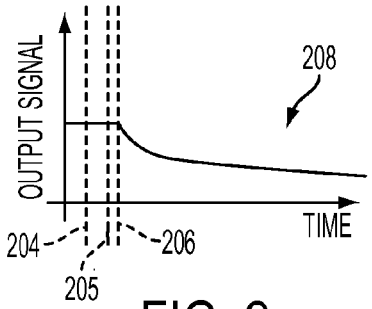

In FIG. 2*b*, cavity pressure, in the y-axis, is shown versus time. In FIG. 2*c*, the graph 203 shows the position of the sense element 102, in the y-axis versus time, in the x-axis, in response to the application of the electrostatic force. FIG. 2*d* shows the graph 207 in the reset mode where a reset signal is applied through the time 206 and FIG. 2*e* shows the graph 208 of the output of the acoustic sensor 103 in response to the reset signal of graph 207. After time 206, the graph 208 is shown to decay. In an embodiment of the invention, the test controller 107 generates the reset signal and applies the same to the acoustic sensor 103 of FIG. 1.

In summary, the graph 201 shows the electrostatic force used to actuate the moveable sensing element 102 versus time. The graph 202 shows the cavity pressure versus time. The graph 203 shows the position of the moveable sensing element 102 versus time. At time 204, the electrostatic force is applied. This force moves the moveable sensing element 102 away from the cavity 105, which creates a sharp change in the cavity pressure between time 204 and time 205. After time 205, the cavity pressure begins to slowly equilibrate with the ambient pressure. The rate of pressure equalization is a function of the cavity leakage. This time constant affects both the cavity pressure equalization and the moveable sensing element's motion. The time constant of the exponential decay in the sense element's position after time 205 can therefore be used to measure the cavity leakage. Specifically, the decay takes a form approximated by the function, shown in the Eq. (1) below.

$$f(t) = \left(A_0 - A_1 e^{\frac{-t}{\tau}}\right), \qquad \text{Eq. (1)}$$

where $A_1$ and $A_0$ represent arbitrary offset and scaling terms that are not relevant to this discussion, and the time constant $\tau$ is defined by the following relationship:

$$\tau = R_{BC}/K_{BC} \quad \text{Eq. (2),}$$

where $R_{BC}$ is the cavity leakage resistance that is being measured by this test $K_{BC}$ is the cavity spring constant, which depends on parameters that are known or can be measured separately (e.g. cavity volume and ambient pressure).

The motion of the moveable sense element 102 in response to the transient pressure signal can be large in comparison to its response to a typical acoustic signal. Furthermore, if the cavity test pressure is created electrostatically, electrical feedthrough can create a very large signal in the frontend circuitry, i.e. the sense amplifier 106 and test controller 107 of the acoustic sensor 103. Fortunately, only the exponential decay after time 205 is needed to measure the cavity leakage. To prevent the test signal from saturating the sensor before time 205, the moveable sensor's frontend circuitry can be held in reset mode until a time 206 which is after time 205. An exemplary reset signal is shown in the graph 207. With this reset signal, the output of the acoustic sensor 103, shown by the graph 208, remains fixed until the reset is released at time 206 and the frontend circuitry is no longer held in reset mode. The exponential decay of the cavity pressure can then be measured from the acoustic sensor output starting at time 206.

Figure 3:
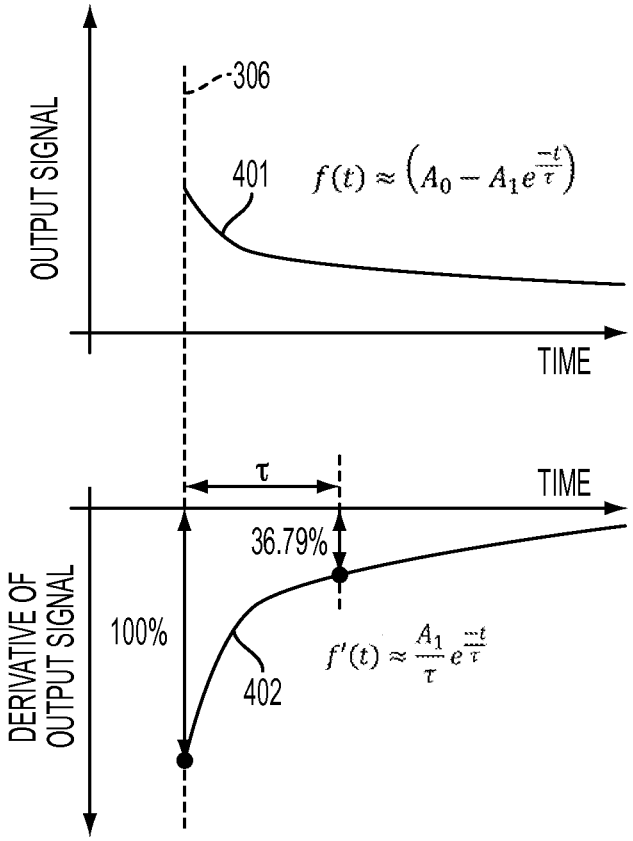
FIG. 3 illustrates how to extract the time constant $\tau$ from a waveform f(t) that has been captured by the test controller, at the output of the sense amplifier, in accordance with a method and embodiment of the invention.

FIG. 3 illustrates how to extract the time constant $\tau$ from a waveform f(t) 301 that has been captured by the test controller 107, shown in FIG. 1, at the output of the sense amplifier 106 starting at time 206, shown in FIG. 2. First, the time derivative of the waveform f'(t) 302 is calculated. The time constant $\tau$ is equal to the time required for f'(t) to decay to 36.79% ($=e^{-1}$) of the value it has at time 206.

Figure 4:
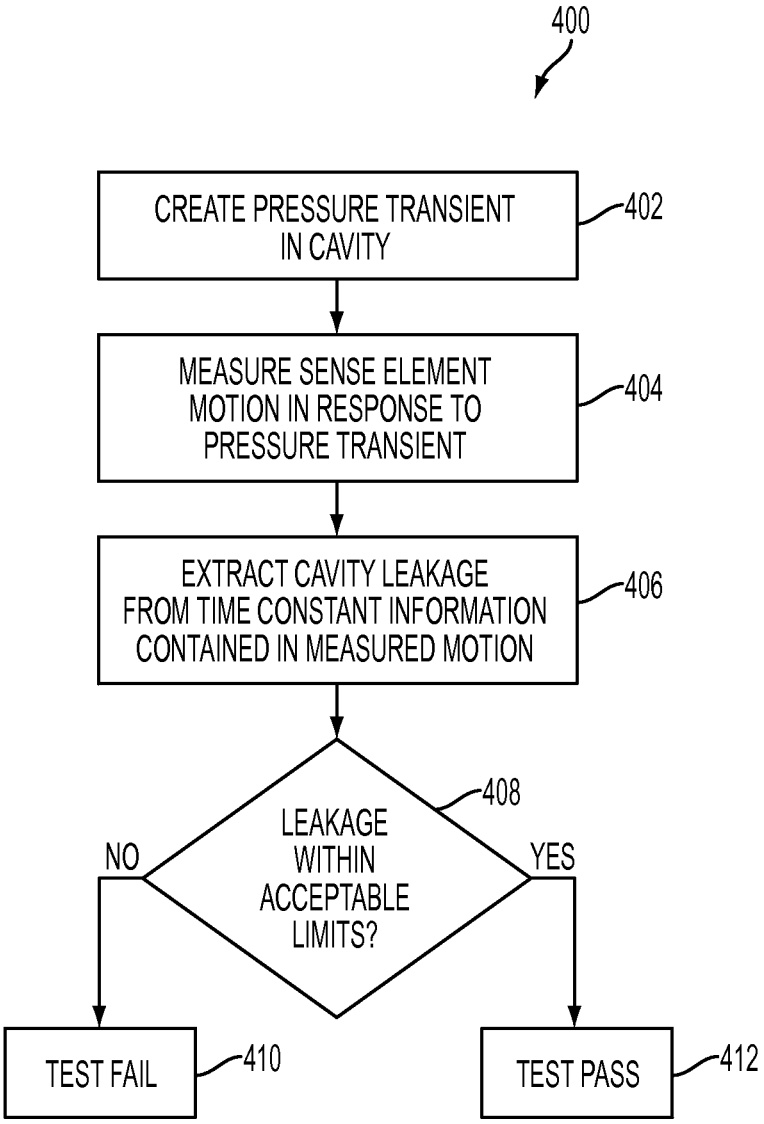
FIG. 4 shows a flow chart 400 for testing an acoustic sensor, in accordance with a method of the invention.

FIG. 4 shows a flow chart 400 for testing an acoustic sensor, in accordance with a method of the invention. At step 402, a pressure transient is created in the cavity 105 of the acoustic sensor 103. More specifically, the test controller 107 of FIG. 1 sends a command to the acoustic sensor 103, and the acoustic sensor 103 applies a voltage through the voltage source 101 upon receiving the command.

Next, at step 404, the motion of the moveable sense element 102 in response to the pressure transient is measured by the acoustic sensor 103. Next, at step 406, the cavity leakage is extracted from time constant information that is contained in the measured motion of the sensor element by the test controller 107. Subsequently, at 408, a determination is made by the test controller 107 as to whether or not the extracted cavity leakage is within acceptable limits and if it is determined that the leakage is intolerable, the test is declared as having failed at 410, otherwise, the test is declared as having passed at 412.

In some embodiments of the invention, testing of the acoustic sensor is performed inside an integrated circuit that includes the acoustic sensor system 100, and in other embodiments the test is performed externally to the integrated circuit chip.

In accordance with various methods and embodiments of the invention, any leakage path from the cavity to the outside environment can be measured by applying a pressure transient inside the cavity 105. Furthermore, the cavity pressure transient can be created electronically using electrostatic forces. By creating the pressure transient using hardware that is already built into the acoustic sensor 103, as example of which is shown in FIG. 1, low-cost integration of a test that traditionally requires external acoustic hardware is realized.

In accordance with a method of the invention for testing an acoustic sensor, the test uses an electrostatic step as a stimulus. This allows for faster test time compared to measuring the response to an acoustic sinusoid at low frequency.

Additionally, this test can be run automatically by the user after assembly, or in the field, because the test can be implemented with components that are integrated into or alongside the acoustic sensor in the audio system. Cavity leakage is sensitive to package integrity and could be affected by the assembly process. As a result, measuring cavity leakage after assembly without the need for external acoustic test equipment is a valuable feature.

Although the description has been described with respect to particular embodiments thereof, these particular embodiments are merely illustrative, and not restrictive.

As used herein, the term "top", "bottom", "left", and "right" are relative and merely examples of the structures disclosed. It is understood that the relation of the structures may be opposite to that which is stated. For example, the term "bottom", as used herein, may be "top" in other embodiments of the invention.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What we claim is:

1. An acoustic sensor system comprising:

an acoustic sensor with a cavity, a cavity leakage, and a cavity pressure; and a test controller coupled to the acoustic sensor and configured to generate a change in the cavity pressure and to detect a response of the acoustic sensor to the change in the cavity pressure, the pressure being in the form of an exponential decay, wherein the test controller is configured to measure a motion of a moveable sense element in response to the change in cavity pressure and to determine the cavity leakage from the measured motion.

2. The acoustic sensor system of claim 1, wherein the test controller is configured to apply an electrostatic force to change the cavity pressure.

3. The acoustic sensor system of claim 1, wherein the test controller is configured to apply a magnetic force to change the cavity pressure.

4. The acoustic sensor system of claim 1, wherein the test controller is configured to apply a thermal force to change the cavity pressure.

5. The acoustic sensor system of claim 1, wherein the test controller is configured to apply a piezoelectric force to change the cavity pressure.

6. The acoustic sensor system of claim 1, wherein the cavity is a back cavity.

7. The acoustic sensor of claim 1, wherein the test controller is configured operable to determine the cavity leakage by measuring the rate of the exponential decay.

8. The acoustic sensor of claim 1, wherein the acoustic sensor includes a moveable sensor element, further wherein a force applied by the test controller causes the moveable sensor element to change the volume of the cavity.

9. The acoustic sensor of claim 8, wherein a voltage is applied between the moveable sensor element and at least an electrode.

10. The acoustic sensor of claim 8, wherein the moveable sensor element is a diaphragm.

11. The acoustic sensor of claim 8, further including at least one electrode, the at least one electrode and the moveable sensing element forming a capacitor, wherein the test controller is configured to apply a voltage between the moveable sensing element and the at least one electrode thereby creating a force to change the cavity pressure.

12. The acoustic sensor of claim 11, further including a sense amplifier responsive to the motion of the moveable sensing element.

13. The acoustic sensor of claim 8, wherein the moveable sensor element includes two sensor elements, one of the two sensing elements used to change the cavity pressure and the other one of the two sensing elements used to sense the change in cavity pressure.

14. The acoustic sensor of claim 8, wherein the cavity leakage substantially affects a time constant of an exponential decay in the position of the moveable sensor element upon change in cavity pressure.

15. The acoustic sensor of claim 1, wherein the test controller is physically coupled to the acoustic sensor.

16. The acoustic sensor of claim 1, wherein the test controller is coupled to the acoustic sensor through a wireless connection.

17. The acoustic sensor of claim 1, wherein the test controller is a part of the acoustic sensor.

18. The acoustic sensor of claim 1, wherein the acoustic sensor is a microphone.

19. The acoustic sensor of claim 1, wherein the test controller and the acoustic sensor are in the same package.

20. The acoustic sensor of claim 1, wherein the test controller and the acoustic sensor are on the same integrated circuit.

21. A method of measuring a cavity leakage of an acoustic sensor with a back cavity, the back cavity having a pressure, the method comprising: creating a change in the pressure of the back cavity:

detecting by a test controller a response to the change in the pressure wherein the response is in the form of an exponential decay:

using the detected response, measuring a motion of a moveable sense element-in response to a change in the pressure; and determining by the test controller the cavity leakage from the measurement of the motion of the moveable sense element.

22. The method of measuring of claim 21, further including applying a reset signal to prevent a sense amplifier from responding to the motion of the moveable sense element until the reset signal is no longer applied.

23. The method of measuring claim 22, further including generating the reset signal by a test controller coupled to the acoustic sensor.

24. The method of measuring of claim 21, wherein the measuring step includes applying a voltage between the sense element and at least one electrode thereby causing a force to be applied to the moveable sense element.

25. The method of measuring of claim 21, wherein the determining the cavity leakage includes measuring the rate of exponential decay.

26. The method of measuring of claim 21, further including determining whether or not the measured cavity leakage is within an acceptable limit.

* * * * *